US008857690B2

(12) United States Patent
Watson

(10) Patent No.: US 8,857,690 B2
(45) Date of Patent: Oct. 14, 2014

(54) DIVER'S COMPRESSION TRIFOLD BACKPACK

(76) Inventor: Chad Michael Watson, Vancouver, WA (US)

( * ) Notice: Subject to any disclaimer, the term of this patent is extended or adjusted under 35 U.S.C. 154(b) by 1489 days.

(21) Appl. No.: 12/287,975

(22) Filed: Oct. 14, 2008

(65) Prior Publication Data

US 2010/0089955 A1 Apr. 15, 2010

(51) Int. Cl.

| | |
|---|---|
| ***A45F 4/02*** | (2006.01) |
| ***A45F 3/04*** | (2006.01) |
| ***A45C 7/00*** | (2006.01) |
| *B63C 11/02* | (2006.01) |

(52) U.S. Cl.

CPC ..... *A45F 3/047* (2013.01); *B63C 2011/025* (2013.01); *A45F 2003/045* (2013.01); *A45C 7/0095* (2013.01); *B63C 11/02* (2013.01)

USPC ..... 224/581; 224/583; 224/645; 224/684

(58) Field of Classification Search

USPC ..... 224/153, 581–583, 650–652, 684, 934, 224/645

See application file for complete search history.

(56) References Cited

U.S. PATENT DOCUMENTS

| | | | | | |
|---|---|---|---|---|---|
| 116,874 | A * | 7/1871 | Schaefer | 224/659 |
| 2,764,327 | A * | 9/1956 | Stevenson | 224/635 |
| 4,169,550 | A * | 10/1979 | Williams | 224/633 |
| 4,655,343 | A * | 4/1987 | Lane et al. | 206/287.1 |
| 4,884,731 | A * | 12/1989 | Sibley | 224/651 |
| 4,961,522 | A * | 10/1990 | Weber | 224/585 |
| 5,012,964 | A * | 5/1991 | Falletta et al. | 224/153 |
| 5,573,154 | A * | 11/1996 | Tietze | 224/153 |
| 5,803,333 | A * | 9/1998 | Fawcett | 224/652 |
| 5,927,575 | A * | 7/1999 | Gatling | 224/153 |
| 5,975,393 | A * | 11/1999 | Bellamy | 224/655 |
| 6,193,118 | B1 * | 2/2001 | Kearl | 224/153 |
| 6,203,246 | B1 * | 3/2001 | Courtney et al. | 405/185 |
| 6,296,094 | B1 * | 10/2001 | Knecht | 190/107 |
| 6,334,519 | B1 * | 1/2002 | Tong | 190/107 |
| 6,484,912 | B2 * | 11/2002 | Jones | 224/153 |
| 6,712,250 | B2 * | 3/2004 | Vigny | 224/640 |
| 7,600,619 | B2 * | 10/2009 | Sapyta | 190/107 |
| 7,604,102 | B2 * | 10/2009 | Albritton | 190/107 |
| 8,006,875 | B2 * | 8/2011 | Watson | 224/250 |
| 2003/0197044 | A1 * | 10/2003 | Webb | 224/584 |
| 2004/0129602 | A1 * | 7/2004 | Sapyta et al. | 206/748 |
| 2007/0017942 | A1 * | 1/2007 | Hubbell | 224/148.2 |

* cited by examiner

*Primary Examiner* — Brian D Nash
*Assistant Examiner* — John Cogill
(74) *Attorney, Agent, or Firm* — Mark S. Hubert

(57) ABSTRACT

A travel bag for organizing and compressing all the diving equipment generally taken by divers on diving vacations. The bag is a belt and shoulder strap supported trifold roll design made of a reinforced synthetic fiber that has no central cavity but rather, three panels with or without see through mesh to enclose pockets on the panels. The bag is washable and has no corrodible components thereon. The main features of the bag reside in it's ability for protective organization and protection of the delicate contents as well as a design suited for rapid opening and visual inspection for ease of access through security checkpoints. A plethora of accessories exist to enhance the versatility of the bag.

10 Claims, 11 Drawing Sheets

DIVER'S COMPRESSION TRIFOLD BACKPACK

BACKGROUND OF THE INVENTION

The present invention relates to a extremely compact travel bag adapted to both organize and protect expensive diving gear in a trifold style backpack bag that is compressible, and designed to provide ease of transportation through today's enhanced safety checkpoints at airport terminals.

Many Americans enjoy diving, a sport that requires expensive equipment that must be properly maintained so as to provide an enhanced degree of safety when in use. Most ardent divers travel to and vacation in remote locations to experience diving hot spots, bringing along their own regulators, buoyancy compensation devices, dive computers, cameras, mask, fins etc. Because of their physical size they are generally put into checked baggage where the handling of this bulky, delicate equipment is questionable. The present invention is a roll style (open trifold) transport backpack that organizes a diver's equipment and compresses it such that it qualifies as carry on luggage. The compression is accomplished via a set of internal straps and three wide, unitary external straps. The compression strapping is such that it does not stress any of the bags stitching, fabric or seams. Quick release buckles on these external straps allow the bag to be quickly opened for Customs Agents or TSA Security personnel, and rolled out for visual inspection without removing all of the gear form the bag. Once opened the bag has see through netting and a webbed caddy that houses certain pieces of diving equipment for dunking in a fresh water tank. Thus when the compression straps are unbuckled and the transport bag unrolled, a full visual inspection of the bag's contents can be made without any further action. Since the diving regulators and computers may have liquid filled gauges security Xrays generally detect this and TSA regulations require a visual inspection. This new transport bag simplifies this process.

The exterior of the bag is conformed with backpack style carrying straps and is designed to accommodate additional baggage modules and to hold such articles as shoes, towels, drinking bottles etc.

Henceforth, a diver's compression trifold backpack with the abovementioned features would fulfill a long felt need in the diving industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a device or integrated system for the personal transport of diving equipment that is able to protect, organize and quickly display the contents and provide a method for compression such that the overall dimensions comply with the acceptable sized for carry on luggage.

It has many of the advantages mentioned heretofore and many novel features that result in a new transport bag which is not anticipated, rendered obvious, suggested, or even implied by any of the prior art, either alone or in any combination thereof.

In accordance with the invention, an object of the present invention is to provide a washable divers's compression roll backpack capable of organizing diving equipment for protective, cushioned transportation.

It is another object of this invention to provide an improved divers's compression roll bag capable of rapid opening and visual content identification for security inspections.

It is a further object of this invention to provide a belt and shoulder supported divers's compression roll bag sized so as to meet aviation regulations for carry on luggage.

It is still a further object of this invention to provide for a divers's compression roll bag that is capable of a strong compressive closing that does not compromise the integrity of the bag or it's stitching.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
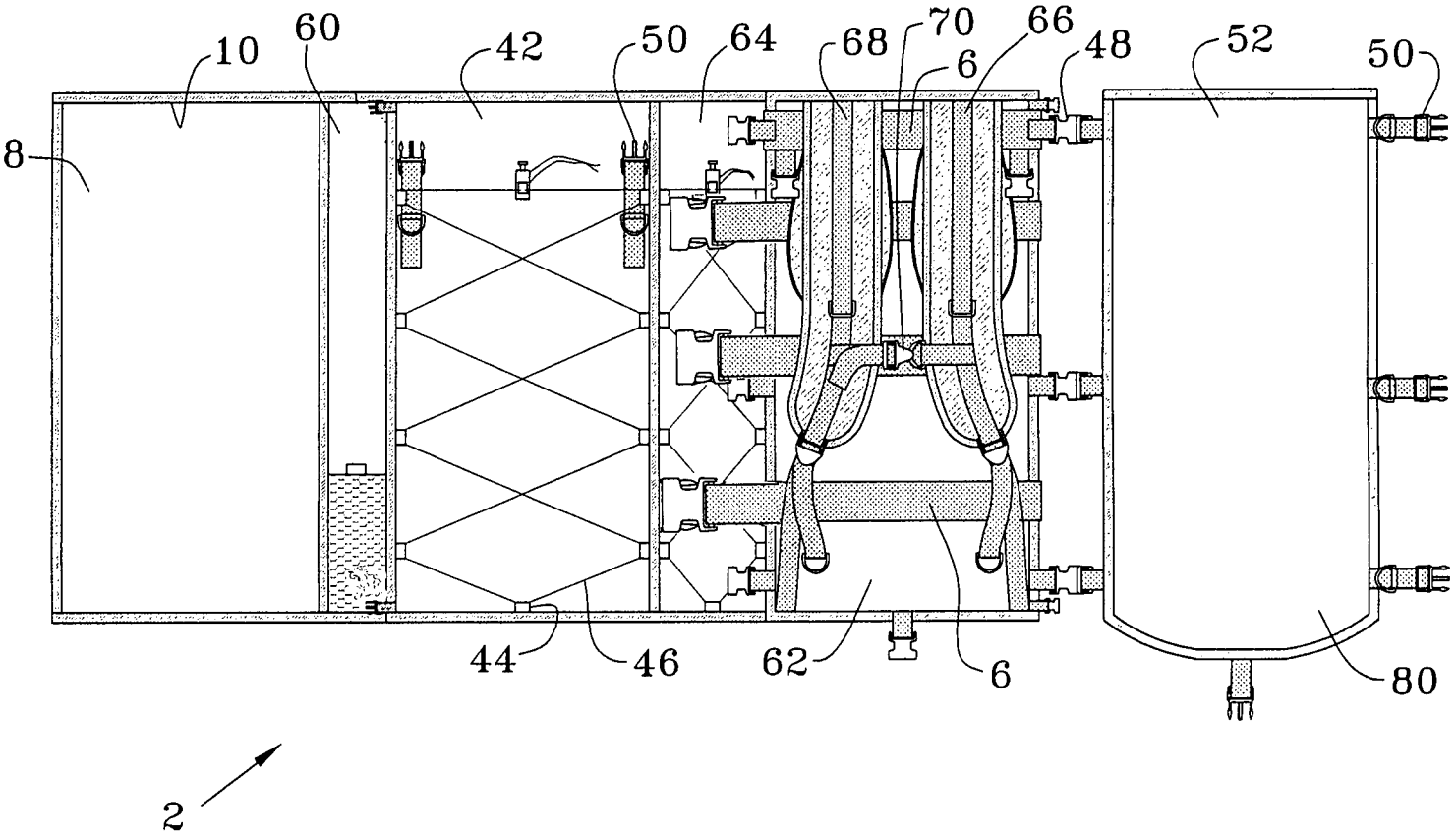
FIG. 1 is a rear side view of the open trifold bag showing the general arrangement of all components and the optional spider bag.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. It is to be noted that in the way of terminology, a "trifold" arrangement generally refers to a design of three generally planar elements that require two folds to place the three elements into a unitary stacked configuration atop one another such as is common in men's wallets.

Figure 2:
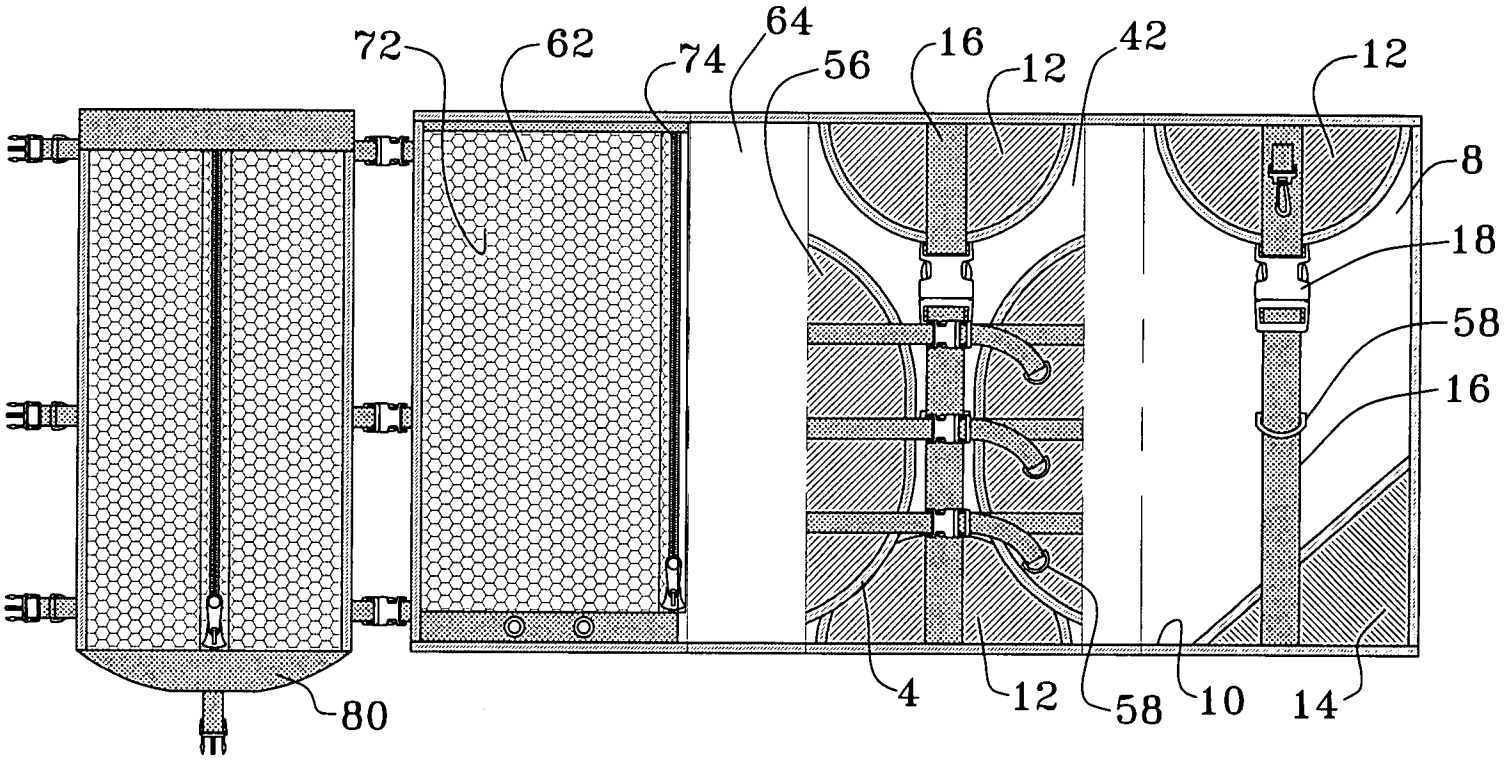
FIG. 2 is a front side view of the open trifold bag showing the general arrangement of all components and the optional spider bag.

Looking at FIGS. 1 and 2 ita can be seen that he present invention is a frameless, non rigid, washable, synthetic fabric divers's compression backpack 2 that is not conformed around an enclosed cavity as in conventional backpacks, but rather is a flat three panel trifold bag with inner compression straps 4 and outer compression straps 6. One of the remarkable features of this backpack 2 is that there is no central cavity for the storage of property, rather it has three panels connected in a linear array by two side strips of differing thicknesses so as to enable the two stages of folding that typify a trifold arrangement.

The preferred material of construction for the backpack panels, and the strapping, peripheral protective piping and the webbing is ballistic or reinforced nylon stitched with a synthetic thread although there is a plethora of synthetic fibers that would also work as would be known by one skilled in the art. The buckles used on the compression straps and attachment straps are of the polymer adjustable, side release style. On the compression straps the "D" rings sewn on the ends of the associated straps are made of plated rust resistant metal or plastic.

It is to be noted that for purposes of clarity the panels are referred to as they would be found in the fully packed and compressed backpack configuration. Thus the terms inner panel, outer panel and back panel refer to the series of sequentially numbered adjacent panels first, second and third numbered from left to right looking at the backpack in the unfolded state from the bottom as displayed in FIG. 1.

The rectangular inner panel 8 has an unadorned or configured back face (FIG. 1) bounded on all peripheral edges by a protective piping 10 stitched onto the panel to reduce wear and prevent fraying of the panel fabric. This piping 10 adorns all exposed edges of the backpack. The front face of the inner panel 8 has a semicircular flap 12 stitchedly affixed to the top of the panel 8 (FIG. 2) and a triangular flap 14 stitchedly affixed to the bottom edge and exposed side of the panel. The exposed edges of both flaps have protective piping 10 sewn on as well. An adjustable securement strap 16 centrally traverses the height of the inner panel 8, being stitchedly connected to the panel's top and bottom edges. The strap 16 is a two piece construction of polymer webbing with one half of an adjustable, polymer side release buckle 18 stitchedly connected to the free end of a first strap section and the matingly conformed second half of the buckle slideably retained on the second strap section by the interweaving of the second strap section through a set of slots formed in the buckle second half. The free end of the second strap section has a D ring 58 sewn thereon to facilitate hand adjustment. A short strap with a U clip is sewn onto the top of the first strap section for the connection of accessories. It is to be noted that all of the buckles and strapping arrangements used herein are of the same basic design regardless of their function.

Figure 7:
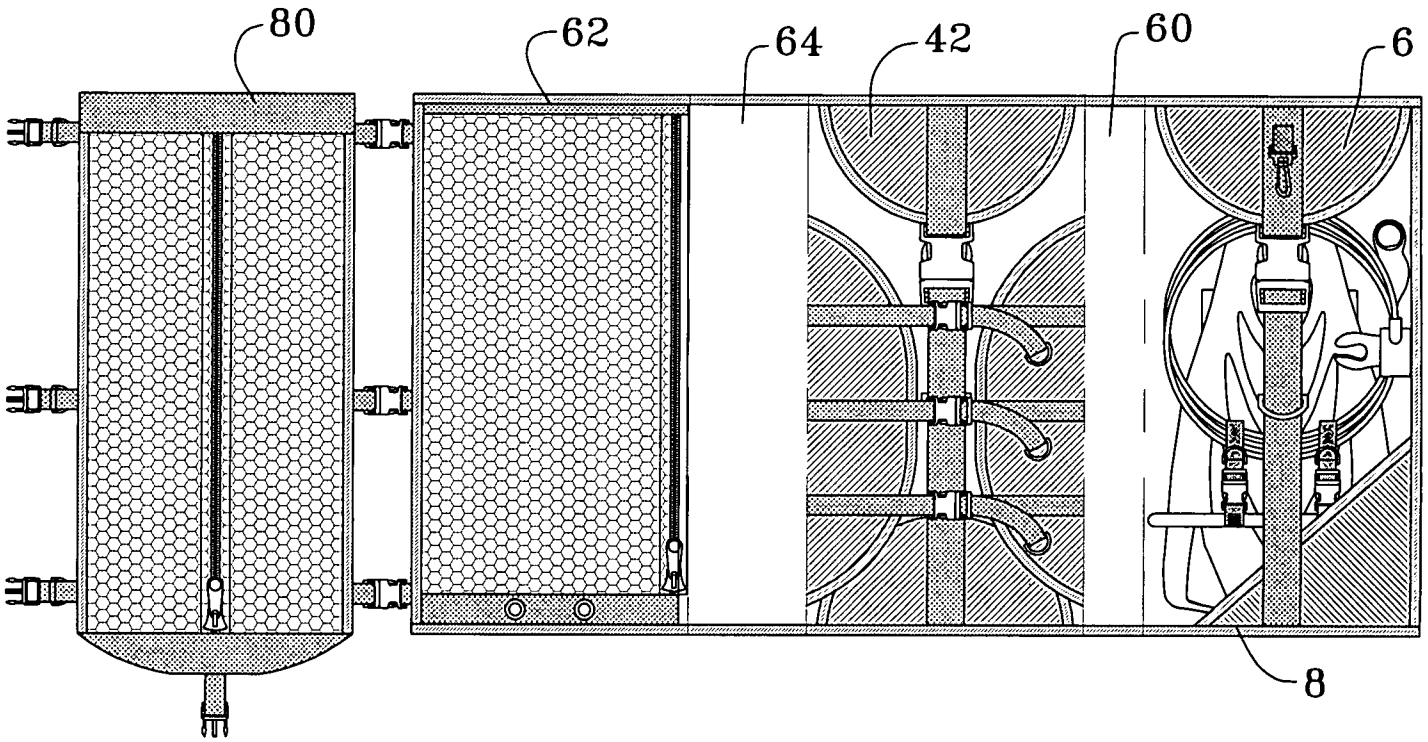
FIG. 7 is a front side view of the open trifold bag showing with the fin caddy inserted.
Figure 10:
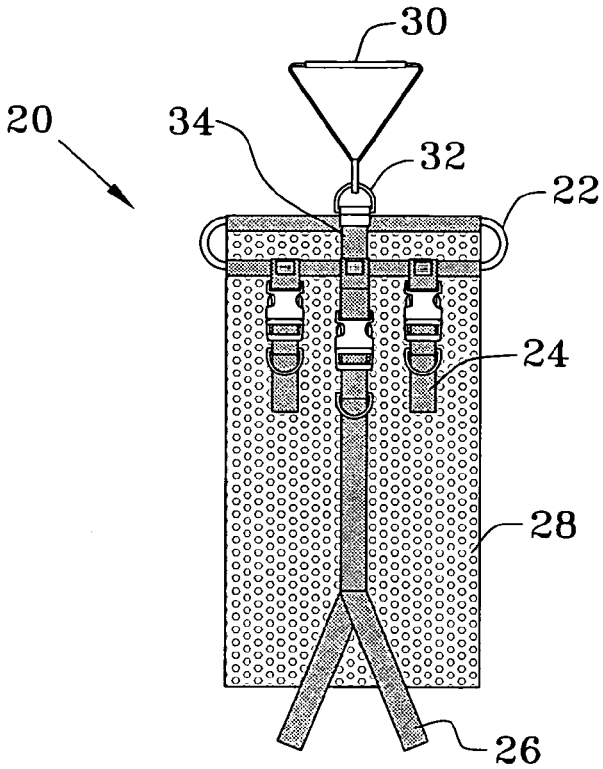
FIG. 10 is a front view of the fin caddy.
Figure 11:
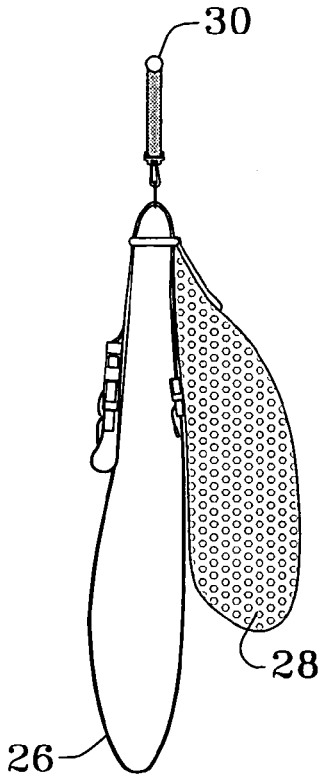
FIG. 11 is a side view of the fin caddy.
Figure 12:
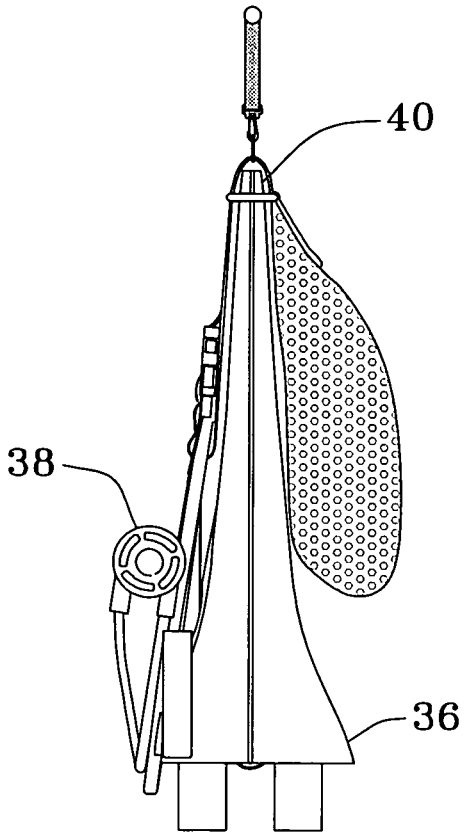
FIG. 12 is a side view of the fin caddy with a pair of ins, a regulator and goggles stored therein.

The inner panel 8 was designed to house a specific element, a fin caddy, FIGS. 10-12 which is described briefly herein, and is the subject of a copending patent application. The fin caddy 20 has an elastic suspension ring 22 from which two regulator retention straps 24, a diving fin retention split strap 26 and a mesh bag 28 are affixed. A removable carrying handle is attached to a D ring 32 sewedly attached to a stub strap 34 affixed to the suspension ring 22. When the fins 36, regulator and hoses 38, diving computer and goggles are constrained by the fin caddy 20, the entire unit may be placed onto the front of the first panel 8 underneath the semicircular flap 12 and the triangular flap 14 such that the diving fin tips 40 partially reside in the pocket created by the triangular flap 14 and the diving fin heel cups reside under the semicircular flap 12. This along with the securement strap 16 prevents the shifting of the fin caddy's contents. The regulator and hoses 38 are always visually exposed when the fin caddy 20 is located in/on the first panel 8. In this manner when the first panel 8 is folded onto the central panel 42 the sensitive, expensive regulator/s are sandwiched between the flexible fins 36 and a buoyancy compensation device (BCD) which is compressedly located in the central panel 42 as discussed herein. The arrangement of the fin caddy in inner panel 8 is shown in FIG. 7. When the backpack 2 is unfolded all of the stored items are visible. This is especially important for the regulator gauges which often have fluid therein and are confusing to identify through XRAY machines.

The outer panel 42 has front face (FIG. 1) with a series of loops 44 stitched about the periphery on the piping 10 through which an elastic cordage 46 may be laced, and three fixed buckle first halves 48 affixed on the edge of the side nearest the inner panel 8. These buckle first halves 48 engage with three buckle second halves 50 located on a detachable spyder bag 52 that may be optionally attached to the front face of the outer panel 42 for additional storage. The elastic cordage 46 stores The outer panel's front face also has a pair of buckle second halves 50 attached to adjustable straps with D rings for the attachment of yet another small mess bag 54. (FIG. 14) Although not illustrated, there is a small closeable fabric bag sewn to the bottom edge of the outer panel 42 to house the elastic cordage 46. The cordage 46 when laced, allows the storage of wet items such as towels, sandals etc. for ventilation and drying purposes. Also this manner of storage allow for rapid visual inspection. The inner side of the outer panel 42 has one semicircular flap 12 stitchedly affixed to the top edge, one semicurcular flap 12 stitchedly affixed to the bottom edge, and two semioval flaps 56 stitchedly affixed to the side edges. (FIG. 2) An adjustable securement strap 16 centrally traverses the height of the outer panel 8, being stitchedly connected to the panel's top and bottom edges. Three inner compression straps 4 extend between the sides and across each of the semioval flaps 56 so as to reside normal to the securement strap 16. These inner compression straps 4 do not encircle the outer panel 42 but rather have two separate strap halves with their fixed ends stitched to the sides of the panel. The inner side of the outer panel is conformed to house a buoyancy compensation device (BCD). The BCD is basically an air inflatable vest and is bulky as it is formed to fit around a human body. When the BCD is placed under the flaps and securement strap 16, the inner compression straps 4 may be bucked and the D rings 58 may be snugged to flatten and partially compress the BCD to a planar shape.

Figure 3:
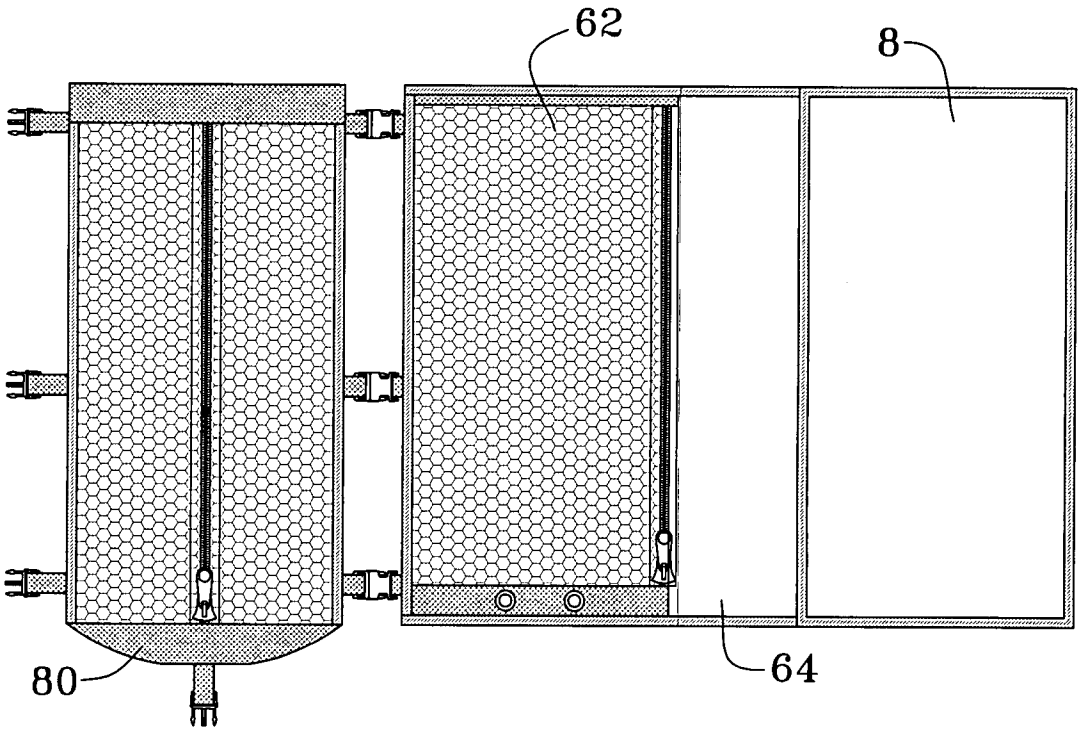
FIG. 3 is a front side view of the partially folded trifold bag.

The inner panel 8 is stitchedly connected to outer panel 42 by a strip of fabric that forms a narrow side panel 60. (FIGS. 1, 2 and 3) The width of the narrow side panel 60 corresponds to the combined thickness of the inner panel 8 and the outer panel 42 when they are in a stacked configuration so as to reside atop each other as depicted in FIG. 3.

The back panel 62 has a back side with two padded shoulder straps 66 sewn thereon. (FIG. 1) The freedom of movement of shoulder straps 66 to accommodate different sized individuals is adjusted by adjustment straps 68 that are sewn along the length of the shoulder straps and connect the shoulder straps 66 to the bottom of the back panel 62. The adjustment straps 68 as well as the shoulder straps are stitchedly affixed to the top edge of the back panel 62. Tightening the adjustment straps 68 will draw the shoulder straps 66 closer to the back panel 62. An adjustable small securement strap 70 connects the two shoulder straps 66. The front side of the back panel 62 has a see through, open mesh panel 72 with a zippered access stitchedly affixed about the back panel 62. This is designed with the enhanced breathability and drainability so as to hold a wet suit. The zipper 74 resides where the back panel 62 meets the wide side panel 64. In this manner when the backpack 2 is in its fully folded position, regardless if the zipper is enmeshed or not, the contents cannot come out of the compartment formed on the back panel 62.

The back panel 62 has three adjustable, unitary outer compression straps 6 sewn onto the back side. (FIG. 1) The operation and buckle design of the outer compression straps 6 are identical with the inner compression straps 4 except that these outer compression straps 6 do not have two separate strap halves with their fixed ends stitched to the sides of the panel as the inner compression straps 4 do. Instead the outer compression straps 6 are of a unitary or loop configuration wherein each of the buckle halves are affixed to an end of the unitary strap. These outer compression straps 6 are at least twice the width of the one inch thick inner compression straps 4.

Figure 8:
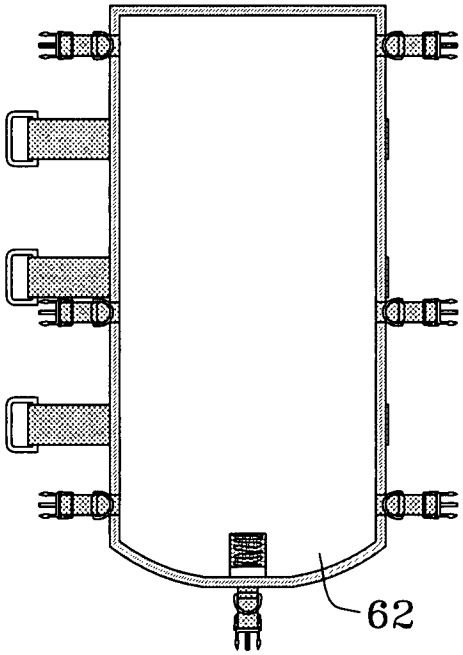
FIG. 8 is a rear side view of the fully folded and compressed trifold bag with the spider bag buckles extended.
Figure 14:
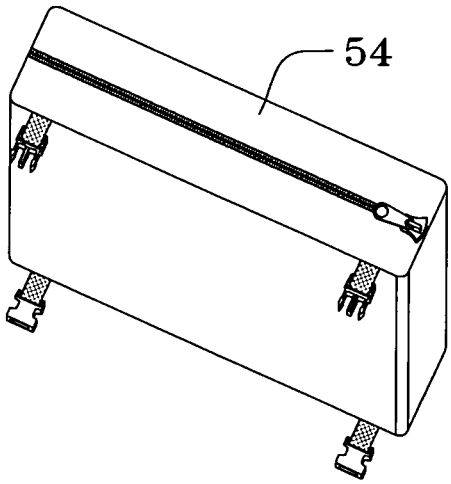
FIG. 14 is a rear perspective view of the optional pouch.

When all the dive paraphernalia is loaded in the three panels, and the panels folded so as to stack atop each other, (FIGS. 4 and 8) the outer compression straps 6 may be wrapped around the entire array, their buckle halves connected and their D rings forcefully pulled so as to compress all the contents of the backpack 2 to their smallest configuration. (FIGS. 5 and 6) In most situations this will allow the backpack 2 to be reduced to the dimensions acceptable for an airplane carry-on. The unitary feature of the outer compression straps 6 allows a uniform compression of the backpack's contents which could not be accomplished with sectional straps. It also allows the compression of the backpack 2 to occur without any stress to the fabric, seams, stitching, piping etc. of the backpack 2 as can be seen in FIG. 14.

Figure 4:
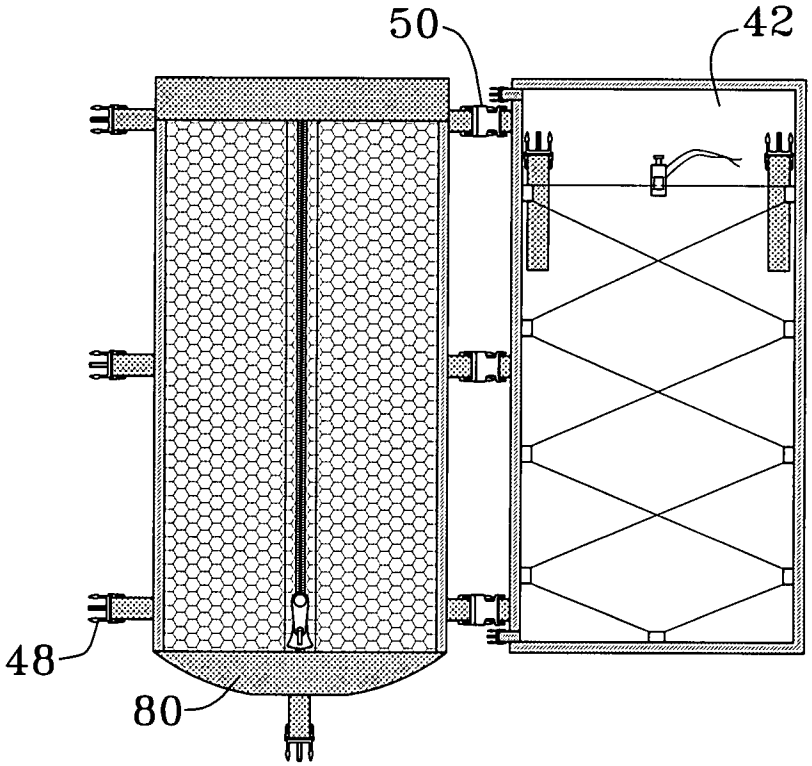
FIG. 4 is a front side view of the fully folded trifold bag.
Figure 5:
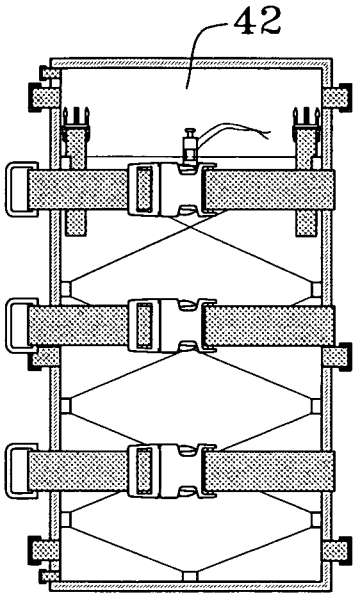
FIG. 5 is a front side view of the fully folded and compressed trifold bag.

The inner panel 8 is stitchedly connected to back panel 62 by a strip of fabric that forms a wide side panel 64. FIGS. 1 and 2) The width of the wide side panel 64 corresponds to the combined thickness of the back panel 64 and the outer panel 42 and the inner panel 8 when they are in a stacked configuration so as to reside atop each other as depicted in FIG. 4.

Figure 6:
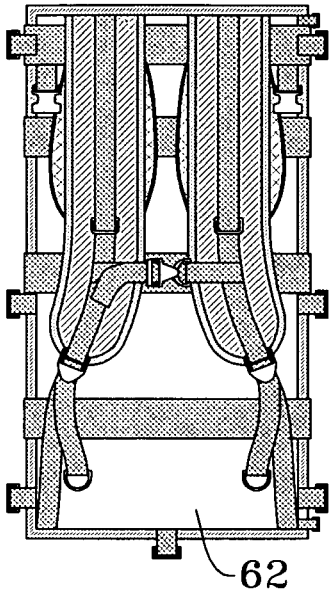
FIG. 6 is a rear side view of the fully folded and compressed trifold bag.

To get to the trifolded state, the sequence of sequentially folding the inner panel 8 onto the outer panel 42 and then this combination onto back panel 62 and then connecting the outer compression straps 6 as depicted in FIGS. 2-3-4-5 must be followed. When fully assembled the backpack 2 as viewed from the back is shown in FIG. 6.

Figure 9:
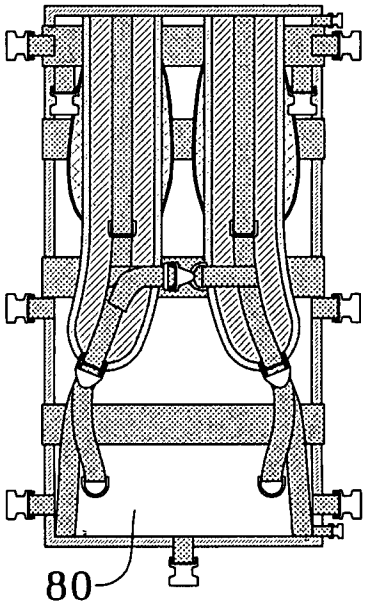
FIG. 9 is a front side view of the fully folded and compressed trifold bag with the spider bag unbuckled.

A large accessory or spyder bag 80 that attaches to the backpack 2 by a series of buckle second halves 50 about its periphery that connect to the mating buckle first halves 48 (FIG. 1) stitched to the edges of the sides of the back panel 62. This spyder bag 80 has an enclosed pocket formed between a sheet of fabric material and a centrally zippered mesh. This is a removable option (FIG. 4) that is able to be attached to the front face of the outer panel 42 such that either the fabric (FIG. 9) or the mesh (FIG. 7) may face outward. When the mesh faces outward the contents of the spyder bag 80 are visible for inspection.

Figure 13:
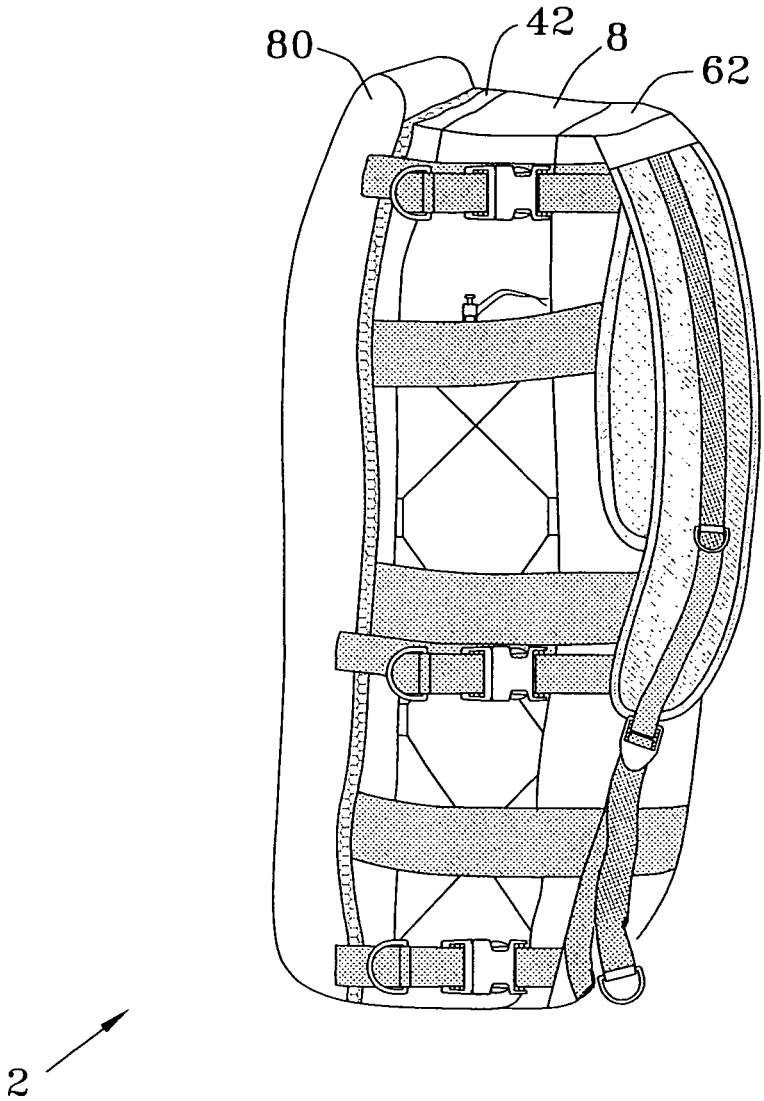
FIG. 13 is a side view of a compressed trifold bag.

In use, the trifold bag is loaded, folded and compressed as described herein (FIG. 13) but upon request of a TSA or other security official, can be opened by unbuckling the outer compression straps 6 and unfolded to lay flat for visual inspection. Once opened, the inner panel 8 and fin caddy 20 contents are visible, (FIG. 7) the BCD in the outer panel 42 is visible and the back panel contents are visible through the mesh panel 72. Further, all stored equipment is neatly organized, can breath and drain water, and can be easily accessed and removed for further inspection. The spyder bag's contents are viewable through its mesh however the spyder bag 80 can be can be quickly removed from the front of the backpack 2 by its buckles.

As is well known in the industry a hip belt to aid in supporting the weight of the bag may be added. This belt would be attachable to the backpack 2 by a series of buckles sewn on the belt and the various panels. Additionally there is room for articles to be stored between the spyder bag 80 and the outer panel 42.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A frameless, non rigid, shoulder supported, washable diver's trifold compression backpack for the compression of SCUBA equipment, arranged to accommodate the dimensions of airline carry-on luggage comprising:

a first flexible, fabric storage panel;

a second flexible, fabric storage panel;

a third flexible, fabric storage panel;

a first flexible fabric side panel;

a second flexible fabric side panel;

a detachable panel;

at least two unitary single strap backpack compression means sewn to said third storage panel;

a shoulder harness having a generally vertical longitudinal axis; and a reinforcing piping;

wherein said all panels are sized and positioned for optimal compression of said SCUBA equipment, and are stitchedly connected to their adjacent panels to form a flexible linear array of panels such that said first storage panel connects to said first side panel which connects to said second storage panel which connects to said second side panel which connects to said third storage panel, and wherein said shoulder harness is affixed to a first side of said third storage panel, and said unitary compression means are fabric straps stitchedly attached to a back side of said third storage panel, said straps having a first end with a first compression buckle half affixed thereto, a second end affixed to a D ring, said D ring encircling said strap and enabling said strap to be pulled to cinch tight said strap, and a second compression buckle half for mating engagement with said first compression buckle half affixed between said D ring and said second end of said straps, said compression straps having longitudinal axes that lie perpendicular to said longitudinal axis of said shoulder harness and encircling said backpack when said backpack is folded such that said first storage panel, said second storage panel and said third storage panel reside in a stacked configuration, and wherein said second side panel has a dimension of width that is larger than a dimension of width of said first side panel, and wherein when said D ring is pulled, said backpack is horizontally constricted by said compression strap without stress to fabric, seams, stitching and piping of said backpack, so as to allow said backpack with said SCUBA equipment therein to comply with the carry-on luggage dimensional restrictions and not to come apart with the high compression forces required to constrain said SCUBA equipment in such a compact form;

and wherein said detachable panel has a series of side release half buckles affixed thereon matingly conformed to a series of complementary side release half buckles affixed to said backpack.

2. The frameless, non rigid, shoulder supported diver's trifold compression backpack of claim 1 wherein said second storage panel is rectangular and has a curved flap sewn to a top edge, a bottom edge, and both side edges, and an adjustable second buckled retention strap traversing atop said flaps and across said panel from said top edge to said bottom edge, and at least two small compression straps traversing atop said flaps and across said panel from side to side.

3. The frameless, non rigid, shoulder supported diver's trifold compression backpack of claim 2 wherein said third storage panel has a side zippered open mesh panel affixed to a second side of said third storage panel so as to form a viewable storage compartment therebetween.

4. The frameless, non rigid, shoulder supported diver's trifold compression backpack of claim 3 further comprising a waist support belt removably attached to said backpack.

5. The frameless, non rigid, shoulder supported diver's trifold compression backpack of claim 4 wherein said second storage panel has a second face with a series of first loops sewn thereon and a first adjustable elastic cordage laced thereon, and said detachable bag has a series of second loops sewn thereon and a second adjustable elastic cordage laced thereon.

6. The frameless, non rigid, shoulder supported diver's trifold compression backpack of claim 3 wherein the number of single strap compression means sewn to said third storage panel is three.

7. The frameless, non rigid, shoulder supported diver's trifold compression backpack of claim 1, wherein said first storage panel is rectangular and has an unadorned first side and a second side with a semicircular flap sewn to a top edge, a triangular flap sewn to a portion of a side edge and a bottom edge, and an adjustable first buckled retention strap traversing across said panel that is sewed to said top edge and said bottom edge, and wherein said SCUBA equipment is selected from at least one member of the group of dive equipment consisting of dive fins, dive regulators, wet suits, diving computers, diving watches, and snorkels.

8. The frameless, non rigid, shoulder supported diver's trifold compression backpack of claim 7 wherein said second storage panel is rectangular and has a first face with a curved flap sewn to a top edge, a bottom edge, and both side edges, and an adjustable second buckled retention strap traversing atop said flaps and across said panel from said top edge to said bottom edge, and at least two small compression straps traversing atop said flaps and across said panel from side to side.

9. The frameless, non rigid, shoulder supported diver's trifold compression backpack of claim 7 wherein said third storage panel has a zippered open mesh panel affixed to a second side of said third storage panel so as to form a storage compartment therebetween.

10. The frameless, non rigid, shoulder supported diver's trifold compression backpack of claim 1 wherein said third storage panel has a zippered open mesh panel affixed to a second side of said third storage panel so as to form a storage compartment therebetween.

* * * * *